US009624565B2

(12) United States Patent
Lee et al.

(10) Patent No.: US 9,624,565 B2
(45) **Date of Patent: *Apr. 18, 2017**

(54) NANOCRYSTAL-CONTAINING TITANIUM ALLOY AND PRODUCTION METHOD THEREFOR

(75) Inventors: Sang-Hak Lee, Yokohama (JP); Yoshiki Ono, Yokohama (JP); Hiroaki Matsumoto, Sendai (JP); Akihiko Chiba, Sendai (JP)

(73) Assignees: NHK SPRING CO., LTD., Kanagawa (JP); TOHOKU UNIVERSITY, Miyagi (JP)

( * ) Notice: Subject to any disclaimer, the term of this patent is extended or adjusted under 35 U.S.C. 154(b) by 720 days.

This patent is subject to a terminal disclaimer.

(21) Appl. No.: 13/988,123

(22) PCT Filed: Nov. 22, 2011

(86) PCT No.: PCT/JP2011/077445

§ 371 (c)(1),
(2), (4) Date: Jul. 5, 2013

(87) PCT Pub. No.: WO2012/070685

PCT Pub. Date: May 31, 2012

(65) Prior Publication Data

US 2013/0284325 A1 Oct. 31, 2013

(30) Foreign Application Priority Data

Nov. 22, 2010 (JP) ..... 2010-260600

(51) Int. Cl.

| | |
|---|---|
| ***C22F 1/18*** | (2006.01) |
| ***C22F 1/00*** | (2006.01) |
| ***C22C 14/00*** | (2006.01) |

(52) U.S. Cl.

CPC ..... *C22F 1/183* (2013.01); *C22C 14/00* (2013.01); *C22F 1/00* (2013.01)

(58) Field of Classification Search

CPC ..... C22F 1/183; C22F 1/00; C22C 1/00

See application file for complete search history.

(56) References Cited

U.S. PATENT DOCUMENTS

2012/0168042 A1 7/2012 Lee et al.

FOREIGN PATENT DOCUMENTS

| | | |
|---|---|---|
| EP | 2 481 823 A2 | 8/2012 |
| JP | A-6-272004 | 9/1994 |

(Continued)

OTHER PUBLICATIONS

Conversion Chart of Vickers hardness (HV) to Rockwell C (HRC), http://www.taylorspecialsteels.co.uk/pages/main/conchart.htm, internet retrieval date of Jan. 10, 2016.*

(Continued)

*Primary Examiner* — Jonathan Langman
(74) *Attorney, Agent, or Firm* — Oliff PLC

(57) ABSTRACT

An alloy having an α' martensite which is a processing starting structure is hot worked. The alloy is heated at a temperature increase rate of 50 to 800° C./sec, and strain is given at not less than 0.5 by a processing strain rate of from 0.01 to 10/sec in a case of a temperature range of 700 to 800° C., or by a processing strain rate of 0.1 to 10/sec in a case of a temperature range of 800° C. to 1000° C. By generating equiaxial crystals having average crystal particle diameters of less than 1000 nm through the above processes, a titanium alloy having high strength and high fatigue resistant property can be obtained, in which hardness is less than 400 HV, tensile strength is not less than 1200 MPa, and static strength and dynamic strength are superior.

8 Claims, 3 Drawing Sheets
(2 of 3 Drawing Sheet(s) Filed in Color)

(56) References Cited

FOREIGN PATENT DOCUMENTS

| | | |
|---|---|---|
| JP | A-10-306335 | 11/1998 |
| JP | B2-2961263 | 10/1999 |
| JP | A-2004-107691 | 4/2004 |
| JP | B2-3789852 | 6/2006 |

OTHER PUBLICATIONS

Zherebtsov et al., "Production of Submicrocrystalline Structure in Large-Scale Ti-6A1-4V Billet by Warm Severe Deformation Processing," *Scripta Materialia,* 2004, vol. 51, pp. 1147-1151.
Nakahigashi et al., "Ultra-Fine Grain Refinement and Tensile Properties of Titanium Alloys Obtained through Protium Treatment," *Journal of Alloys and Compounds,* 2002, vol. 330-332, pp. 384-388.
Salishchev et al., "Development of Ti-6A1-4V Sheet with Low Temperature Superplastic Properties," *Journal of Materials Processing Technology,* 2001, vol. 116, pp. 265-268.
Extended European Search Report issued in European Application No. 11843473.7 issued Jun. 4, 2014.
Langdon et al., "Equal-Channel Angular Pressing (ECAP)," *Materia Japan,* 1998, pp. 767-774, vol. 37, No. 9 (w/ partial translation).
International Search Report issued in International Patent Application No. PCT/JP2011/077445 dated Feb. 28, 2012.

* cited by examiner

NANOCRYSTAL-CONTAINING TITANIUM ALLOY AND PRODUCTION METHOD THEREFOR

TECHNICAL FIELD

The present invention relates to a high-strength titanium alloy and to a production method therefor, and in particular, relates to a high-strength and high-fatigue strength titanium alloy having nanocrystals by hot-working, and a production method therefor.

BACKGROUND ART

Conventionally, as a suspension spring and an engine valve spring in which high strength and high fatigue strength are required, a titanium alloy which is generally classified as a β type, has superior cold workability and has high strength relatively easily by heat treatment, is primarily used, among Ti alloys used in parts for vehicles. The β type Ti alloy is an alloy having a composition classified as a Ti alloy that is age-hardenable after a metastable β phase at room temperature. However, since the β type Ti alloy is ordinarily an alloy in which the β phase, being stable at high temperatures, is treated so as to be metastable at room temperature by solution treatment, it is necessary to contain large amounts of β stabilizing elements such as V, Mo, and Cr, which are expensive. Therefore, Ti alloy parts having comparable strength and being made of inexpensive material has been greatly desired.

In addition, strength of a β type Ti alloy is improved by a heat treatment such as an α phase precipitation aging treatment; however, fatigue strength is important in mechanical parts in practical use. However, breaking of a β type Ti alloy would occur from cracking in an α phase particle precipitated or interface of an α phase and a β phase, and occurrence of the cracking in both cases is considered to be caused by differences in elastic strain between an α phase and a β phase. Therefore, in a structure that is strengthened by precipitation of an α phase from a β matrix phase such as a β type Ti alloy by aging treatment, there have been limitations in improving fatigue strength, even if static strength is superior. In view of such circumstances, application of a near α type or an α+β type Ti alloy, in which content of expensive β phase stabilizing elements is low and content of β phase which is deformed easily and has low strength is low, to vehicle parts, has been anticipated from the viewpoints of fatigue strength and cost.

On the other hand, as disclosed in the Japanese Patent No. 3789852, since Ti-6Al-4V (mass %) alloy, which is typically classified as an α+β type, has good balance in mechanical properties such as strength, ductibility and toughness, the penetration is large, accounting for about 70% in production amount of all Ti alloys. Therefore, Ti-6Al-4V alloy has advantages such as low cost and low variation in component and material strength.

Properties and strengths of such Ti-6Al-4V alloys are mainly affected by formation of structures, that is, whether the structure is made of equiaxial crystal structures, acicular crystals or mixtures thereof (bimodal structures) regarding formation of an α phase. Generally, the equiaxial crystal structure is formed by processing in a temperature range not more than β transus temperature−50° C. for example, and is superior in strength, elongation, generation resistibility of fatigue cracking and plastic workability. The acicular crystal structure is formed by processing in a temperature range not less than β transus temperature+50° C. for example, and is superior in creep resistance, breaking toughness and resistance to propagation of cracks. Furthermore, the mixture (bimodal) structure is formed by solution processing at a temperature just below β transus temperature and subsequent aging treatment at about 550° C., for example, and has both advantages of the equiaxial crystal structure and the acicular crystal structure.

However, it is difficult for the above-mentioned Ti-6Al-4V alloy to have properties superior to static strength of the above-mentioned β type Ti alloy, and in many cases, kinetic property and functional property thereof are controlled by controlling micron size structures and structure formation. However, in recent years, there have been attempts to control microstructures of metallic materials at the nanoscale by using a severe working method such as ECAP (Equal Channel Angular Pressing) method disclosed in "Materials, Vol. 37, No. 9 (1998), pp. 767-774 by Hotta et al.", or ARB (Accumulative Roll-Bonding) method disclosed in Japanese Patent No. 2961263, and as a result, it has been found that metal having nanostructures can yield superior mechanical properties that conventional metallic materials cannot attain.

However, the ECAP method is a method in which a metallic bulk to be processed is repeatedly injected into and passed through a tunnel-like extrusion pathway having one bended part between entrance and exit, so as to give the metallic bulk much shear strain. In such a shear deformation processing method, since there is a limitation in length of the material that is supplied and processed, it is difficult to lengthen the material and to enlarge the apparatus, in principle.

Furthermore, the ARB method has an advantage in that a plate material can be processed in more than process limitation by repeating rolling of stacked rolled plate materials; however, the method can be applied only to a plate material, and cannot be applied practically to mechanical parts having complicated shapes.

SUMMARY OF THE INVENTION

As explained so far, to make nanoscale metallic bulk structures to be processed by a severe working method, it is necessary to accumulate large amounts of strain. However, since only a bulk having simple shape can be produced by the strain giving processing, there are limitations in producing mechanical parts that can be practically used. In addition, strain density inside of the crystal of the material to be processed is large if produced by these severe working methods. Therefore, even if nanoscale crystals are formed, the structure is brittle, and progress ratio of fatigue strength is low compared to that of tensile strength. Accordingly, for the practical realization of structures on the nanoscale, it is necessary that it be produced by further simpler working method, strain density be reduced, and high strength and high fatigue strength be achieved at the same time.

The present invention was completed to solve the above-mentioned subjects, and an object of the invention is to provide nanocrystal-containing Ti alloy and a production method therefor, in which nanocrystals can be easily induced in a material to be processed without using a complicated process, and in which high strength and high fatigue strength for industrial practical use are achieved.

In particular, another object of the invention is to provide a Ti alloy suitable as an alternative material of a β type Ti alloy for a structural material, including parts for vehicles, by greatly improving strength and fatigue strength of a general standard composition alloy of an inexpensive Ti-6Al-4V type having high penetration, or Ti alloy having a structure classified as near α type or α+β type, and a production method therefor.

The inventors have researched to make inexpensive Ti alloy compositions, not β type Ti alloy compositions, which are classified as near α type or α+β type having a low β phase ratio at room temperature by ordinary cooling after solution treatment. As a result, they have completed the Ti alloy of the present invention in which high strength and high fatigue strength are achieved while maintaining workability for parts by making a fine equiaxial crystal structure having low strain density and nanoscale crystal particle diameter smaller than a conventional micron size structure, and in which further stabilization of fatigue strength can be expected by further reducing a β phase as much as possible. To obtain such a Ti alloy, in the present invention, formation and stabilization of nanocrystal particle structure having low strain density is achieved, by performing hot working of the present invention, in which an α' martensite phase is used as a processing starting structure, which has not been conventionally used.

The Ti alloy of the invention was accomplished in view of the above knowledge, Ti alloy has a composition generally classified as near α type and/or α+β type titanium alloy, structure in which equiaxial crystals having average crystal particle diameters of less than 1000 nm are uniformly dispersed, hardness less than 400 HV, and tensile strength not less than 1200 MPa, by performing hot working of an α' martensite phase as a processing starting material which is generated by rapid cooling from a temperature not less than a β transus temperature. The Ti alloy of the present invention is explained as follows.

The Ti alloy has high notch sensitivity, and its cracking propagation speed is greater compared to the case of steel materials when cracking is generated. However, by equiaxial nanocrystallization of structure having low strain density, migration of dislocation is limited, and thus resistivity against cracking spreading in addition to initial cracking generating resistivity are improved. Furthermore, since the structure has low strain density, compressive stress can be remain deeper inside of the structure compared to a conventional structure by shot peening treatment from the surface, and thus fatigue strength can be improved. In addition, the processing method of the present invention is further easier than a conventional severe working method, dynamic recrystallization is generated during hot working, equiaxial crystal in an area to which strain not less than 0.5 is applied becomes not less than 80%, nanoscale fine equiaxial crystal structure having extremely low dislocation density (strain in particle) is generated, and thus the structure defined in the present invention can be obtained.

Structure of the processing starting material for the titanium alloy of the present invention is a structure consisting of an α' martensite phase. The α' martensite phase is generated by quenching the Ti alloy after solution treatment, and this is a crystal phase which is formed in non-diffusion transformation during solution quenching process, and this does not occur in a β type Ti alloy in which a β phase remains at room temperature as it is. The α' martensite is acicular crystals, and its crystal structure is hexagonal close-packed crystal structure similar to an equilibrium α crystal; however, unlike the equilibrium α crystal, it becomes a thermally unstable crystal phase by rapid cooling, or it becomes a crystal phase structure having a large amount of defect (α'(10-11) twin crystals, layered defect or dislocation on α'(0001), or the like) in the acicular crystal structure. It should be noted that "−1" means 1 having a bar (−) thereon (similar also to the explanation in paragraph 0023). Therefore, the inventors considered that since an amassed part of such layered defects or dislocations would be energetically unstable and easily act as sites for generation of recrystallization of a nucleus of α, there would be numerous places that are nucleus generating sites compared to the α+β phase structure conventionally used for processing, and by performing hot working using this structure as a starting structure, uniform and fine nanoscale equiaxial crystal may be generated easily and widely. Thus, the present invention has been completed.

That is, the production method of titanium alloy of the present invention includes a step of processing that can develop dynamic recrystallization, versus a starting material for hot working having an α' martensite phase generated by rapid cooling from a temperature not less than a β transus temperature, so that the titanium alloy has a hardness less than 400 HV and a tensile strength not less than 1200 MPa. Here, the starting material is a Ti alloy having a composition of 4 to 9 mass % of Al, 2 to 10 mass % of V, and the remainder of Ti and inevitable impurities.

Here, the method which can develop dynamic recrystallization practically means a processing to heat at a rate of temperature increase of 50 to 800° C./sec, and to make strain not less than 0.5 at a strain rate of 0.01 to 10/sec in a temperature range of 700 to 800° C. Alternatively, to make strain not less than 0.5 at a strain rate of 0.1 to 10/sec in a temperature range of 800 to 1000° C. As the hot working method, a processing method is employed in which dynamic recrystallization is exhibited during processing, such as press processing, extrusion processing or drawing processing. Furthermore, after the hot working, cooling is performed at not less than 20° C./sec in order not to coarsen nanoscale crystal particles generated in the dynamic recrystallization.

A Ti alloy produced by the method above has a composition generally classified as at least one of near α type and the α+β type Ti alloy, and contains a structure in which equiaxial crystals having average crystal particle diameters less than 1000 nm are uniformly dispersed in high area ratio. It should be noted that since the minimum crystal particle diameter that can be observed by SEM/EBSD method of acceleration voltage 20 kV at 50000 magnification is 98 nm, the minimum value of the crystal particle diameter in the present invention is substantially 98 nm. Here, α+β type Ti alloy is a Ti alloy having 10 to 50% of area ratio of the β phase at room temperature depending on the cooling rate of ordinary casting or the like, and near α type Ti alloy is a Ti alloy containing 1 to 2 mass % of the β phase stabilizing element such as V, Cr, Mo or the like and having above 0% to 10% of area ratio of β phase at room temperature depending on the cooling rate. However, in the present invention in which a material which is rapidly cooled and made so as to be an α' martensite phase structure in nearly its entirety (level at which the β phase cannot be detected by an X-ray diffraction method) is used as a starting material and then is hot worked, it is desirable that the area ratio of the β phase be not more than 1.0%. The reason for this is that the possibility of breaking at an interface of an α phase and a β phase is increased and fatigue strength is decreased, in the case in which the area ratio of β phase is over 1.0%. It should be noted that a case in which the β phase is over 50 area % at room temperature and α' martensite transformation does not occur corresponds to a β type alloy.

As is obvious from the GOS map by the EBSD method (right drawing of FIG. 1, the details will be explained in Example), the structure of the Ti alloy of the present invention has a fine and uniform crystal structure in which almost no dislocation (strain) is induced inside the crystal. By preparing the structure of the present invention having high strength of not less than 1200 MPa of tensile strength, the hardness can be controlled at not less than 360 HV and less than 400 HV at the same time since it has low strain density, and thus superior post workability is exhibited.

In the Japanese Patent No. 3789852 above, α' martensite is used as a strengthening method for a Ti-6Al-4V α+β type alloy. In Japanese Patent No. 3789852, strength and toughness are improved by precipitating acicular α crystals in an α' martensite by heat treatment, and it is said that yield strength, hardness and toughness are simultaneously improved. However, although coarsening of crystal particles can be prevented by only the heat treatment disclosed in Japanese Patent No. 3789852, it cannot be expected that toughness and hardness are simultaneously improved, since hardness and toughness are in reverse proportional relationship in a general structure of large crystal particles, that is, micron size. In addition, measurement of toughness is predicted by drawing rate of fracture surface of sample after a tensile test; however, there is no disclosure of a Comparative Example, and thus, it is difficult to make accurate decisions of toughness.

On the other hand, in the present invention in which a crystal is nanoscale and strain density inside a particle is extremely low, workability and strength of a Ti alloy is greatly improved. Furthermore, nanoscale structures can be obtained relatively easily without repeating processing many times, unlike in a severe strain processing method. Next, in the highly strong Ti alloy and production method therefor in the present invention, the reason for the above-mentioned limitation of the structure and production method is explained.

As the Ti alloy composition for forming a α' martensite phase structure which is the starting structure for processing in the present invention, a composition ordinarily classified as near α type or α+β type titanium alloy is suitable. For example, in the case in which a composition ordinarily classified as an α type Ti alloy is rapidly cooled from not less than a β transus temperature in order to generate an α' martensite in the entirety, it becomes inefficient from the viewpoint of heating energy since the β transus temperature moves to a higher temperature region, and since a brittle $\alpha_2$ phase ($Ti_3Al$ for example) is generated in a certain temperature region, as a result, α' martensite phase structure cannot be obtained in the entirety. In addition, since a phase can be metastably maintained in the near β type and β type Ti alloy at room temperature, an α' martensite phase structure cannot be obtained in almost the entirety to the extent in which a β phase is not detected by X-ray diffraction or the EBSD analysis, even if rapid cooling was performed, and it will be confirmed that the β phase remains. Therefore, it cannot be expected to obtain uniform and fine dynamic recrystallization structures by using α' martensite. On the other hand, in a composition ordinarily classified as near α type and α+β type Ti alloy, the β phase is almost not detected in the similar analysis level after the treatment. Therefore, a composition classified as near α type and α+β type Ti alloy are better.

The reason for using an α' martensite phase as the starting structure for processing is that since it is a thermally unstable phase and contains large amounts of defects in the acicular structure, the defects easily act as a generation site of a recrystallization nucleus. In addition, dislocation of α<11-20> which is a-axis direction mainly moves in the acicular crystal α+β structure, and on the other hand, in an α' martensite, deformation ability is greater than in an α structure since dislocation of a c-axis direction also moves actively in addition to a-axis direction, and furthermore, the direction and the number of dislocation intersecting spot of the acicular crystal structure is increased compared to an α+β mixture structure. This intersecting spot acts as a nucleus generation site; that is, it means that many more nucleus generation sites exist in the starting structure for processing compared to an α+β phase by hot working. Therefore, it is advantageous to use an α' martensite as the starting structure for processing in hot working in order to perform nanocrystallization of the structure.

Next, a basis for numerical limitations in the conditions of hot working is explained. The numerical limitations of the present invention were obtained as a result of consideration of the basis that heating is performed in a short time (to prevent coarse precipitation of equilibrium phase) in order not to give the energy (heat and time) given to the starting structure generating crystal particle coarsening or transformation to equilibrium of the α+β phase, and that rapid cooling is performed (to control growing of recrystallization) after processing (generation of many recrystallization nucleus generation sites).

Temperature increase rate: 50 to 800° C./sec

Since an α' martensite phase, which is the starting structure, is a thermally unstable phase, it may give time for phase transformation to an equilibrium α+β phase, if the temperature increase rate is less than 50° C./sec. On the other hand, in the case in which the temperature increase rate is more than 800° C./sec, although this depends on the size of the processed material, it becomes difficult to control temperature in a set of processes or realistic heating means, and it also becomes difficult to obtain the formed structure of the present invention in a wide region since temperature differences between the surface and the inside become too large. Furthermore, in the temperature increase rate of more than 800° C./sec, differences in flowability between the surface and the inside becomes great, and cracking may easily occur during processing. Therefore, the temperature increase rate is 50 to 800° C./sec.

Strain rate: 0.01 to 10/sec at hot working temperature 700 to 800° C.

Strain rate: 0.1 to 10/sec at hot working temperature of 800° C. to 1000° C.

Strain: not less than 0.5

The hot working condition above is a condition in which dynamic recrystallization of Ti alloy occurs actively, and in which average crystal particle diameter of uniform and fine equiaxial crystals are less than 1000 nm when an the α' martensite phase is used as the starting structure for processing. As a result, a structure in which tensile strength is not less than 1200 MPa and hardness is 360 HV to 400 HV can be obtained, and high fatigue strengthening can be realized. At a processing temperature of less than 700° C., driving energy for dynamic recrystallization is less as temperature decreases, and there may be decreased dynamic recrystallization region at a processed part and it may be non-uniform, and as a result, there may be a mixture of structures of coarse α crystal elongated by processing and nanocrystal structure of non-uniform dynamic recrystallization, in the entirety of the structure. Alternatively, there may be a case in which dynamic recrystallization does not occur and a nanocrystal structure is not generated. On the other hand, when processing temperature is not less than 1000° C., generation of a β phase and growing rate may be radically increased, and an equilibrium β phase may coarsen. Subsequently, since it may transform into a coarse α phase or a acicular structure by cooling to room temperature, a structure having expected mechanical property cannot be obtained.

Next, in the case in which a strain rate is less than 0.01/sec at a processing temperature 700 to 800° C. and a strain rate is less than 0.1/sec at a processing temperature of 800° C. to 1000° C., since it may afford time for the structure to α+β to transform and coarsening of the crystal particles in each processing temperature range of the present invention, there may be no advantage in dynamic recrystallization. In addition, in consideration of practical operations, there may be a problem of decrease of productivity. On the other hand, in the case in which a strain rate is greater than 10/sec, it may not be practical from the viewpoint of radical increase of deformation resistance by rapid processing rate, cracking of processed material thereby, and too great a load on a processing apparatus.

Furthermore, equiaxial crystals having average crystal particle diameters of less than 1000 nm is required that is not less than 80% in area ratio of objective member structure. This is because tensile strength may become less than 1200 MPa and improvement of strength and fatigue strength, which is a requirement of the market, is no more obviously exhibited, in the case in which area ratio of the above-mentioned structure is less than 80%. That is, it is necessary that processing be performed so as to generate dynamic recrystallization at not less than 80% of the entirety of objective member (or region). Therefore, it is necessary that strain by processing be not less than 0.5. Furthermore, it is desirable that area ratio of the above-mentioned structure be not less than 90%, and therefore, strain is desirably not less than 0.8. It should be noted that in the case in which orientation angle difference in crystal particles of equiaxial crystals by measurement of a GOS map by an electron backscatter diffraction (EBSD) method is less than 3°, dislocation density (strain in particles) which leads to cracking as a result of strain hardening is low, fatigue strength is improved, hardness is controlled to be 360 HV to 400 HV, and nanocrystals having low strain density efficient for workability in the shaping of parts can be generated. Therefore, a processing which can realize an area ratio of not less than 80%, desirably not less than 90%, by such measurement, is performed. Furthermore, it is not always necessary to form the above-mentioned structure in the entirety of material, depending on how a product is to be used, and the processing conditions of the present invention can be applied to only a required region, and the required region can be formed so that the processed part has an area ratio defined by the present invention, such as at a surface side or the like where operating stress may be high, for example.

It should be noted that strain in the present invention can be described by "e" in the following formula, and that "l" means distance between mark points of processing direction after processing and "$l_0$" means distance between mark points of processing direction before processing in the formula.

$$e=|\ln l/l_0|$$

Cooling rate after processing: Not less than 20° C./sec

After hot working, it is desirable that cooling be performed at a cooling rate not less than 20° C./sec in order not to coarsen nanocrystal particles generated by dynamic recrystallization.

It is desirable that the Ti alloy of the present invention have a composition of Al of 4 to 9 mass %, V of 2 to 10 mass %, and the remainder of Ti and inevitable impurities. In addition, it is desirable that average crystal particle diameter be not more than 600 nm. As a result, hardness can be 360 HV to 400 HV, which is a relatively soft condition, and that tensile strength can be very strong and not less than 1200 MPa.

By the present invention, nanocrystallization can be performed for a Ti-6Al-4V type general standard composition alloy that is inexpensive and has high penetration or for a Ti alloy having a structure ordinarily classified as near α type or α+β type, in a simpler processing method compared to a conventional processing method. As a result, strength and fatigue strength can be greatly improved while maintaining workability, and therefore a Ti alloy can be provided that is suitable for a material which can substitute for a β type Ti alloy of a structural member, such as parts for vehicles.

BRIEF EXPLANATION OF DRAWINGS

This patent application file contains at least one drawing executed in color.

EXAMPLES

A Ti-6Al-4V general standard composition alloy (grade 5) that is industrially generally used was placed in an electric resistance furnace that was preheated, was held at 1050° C. for 1 hour, and was cooled by ice water so as to prepare a Ti-6A-4V of an α' martensite phase as a starting structure for processing. The sample had a diameter of 18 mm and a length of 35 mm. Lateral compression processing of the cylindrical sample was performed by using a general pressing machine (EFP300H, produced by Asai Corporation) as a processing apparatus. Temperature increase profile of the material to be processed was observed in the furnace by preliminary experiment so as to enable rapid heating by furnace heating, and heating condition and processing condition were determined as follows in order to enable collecting test pieces of the Example of the present invention from a central part of the sample. That is, the sample was inserted in the electric resistance furnace in which temperature was maintained at 1100° C. in advance, and at a timing when a temperature of the central part reached about 800° C. (temperature increase rate at this process was 65° C./sec), the sample was processed under conditions of a processing rate of 50 mm/sec (initial strain rate 2.78 to maximal strain rate 5.56/sec), processed amount of 50% by a ratio against lateral height, strain of not less than 0.5 at region of collecting the sample, and was then cooled by ice water (cooling rate 50° C./sec).

After hot working, crystal particle diameter and β phase area ratio of a cross section of a central part processed were measured, and dislocation density was evaluated by an electron backscatter diffraction (EBSD) device (OIM ver. 4.6 produced by TSL Solutions) which was attached to a scanning electron microscope (JSM-7000F, produced by JEOL Ltd.). The crystal particle diameter was determined by the IPF (Inverse Pole Figure, crystal orientation difference not less than 5° was defined as crystal interface) map described in left of FIG. 1, for example, which enables analysis based on EBSD images. Similarly, an area ratio of a β phase was determined by a phase map (difference of crystal structure between an α phase and a β phase), and dislocation density was determined by GOS (Grain Orientation Spread) map analysis of the right of FIG. 1, for example. That is, in the case in which differences of angles of crystal orientation between one analyzed focus point and a point next to the focus point in crystal particle is less than 3°, the crystal was decided that it was generated by recrystallization in which dislocation density in a crystal particle was extremely low, and the area ratio was measured.

Figure 1:
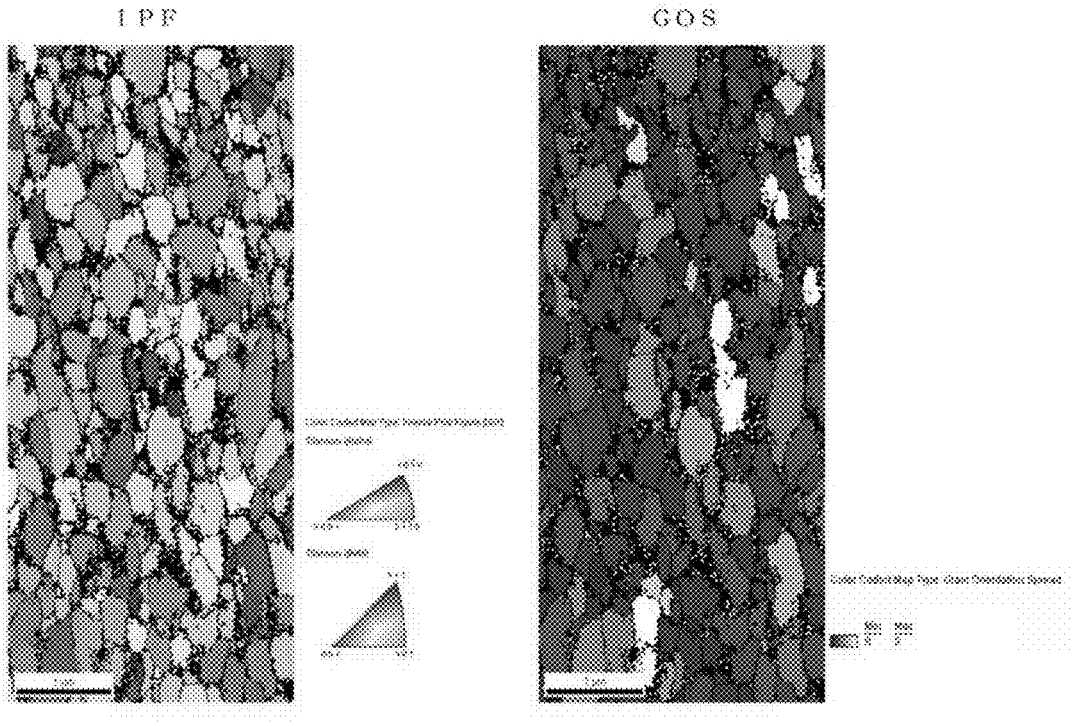
FIG. 1 shows an IPF map (left) and a GOS map (right) of an electron backscatter diffraction image after hot working of Ti-6Al-4V general standard composition alloy consisting of an α' martensite, which is starting material for processing of an Example of the present invention.

FIG. 1 shows result of measuring of electron backscatter diffraction of an Example. Each colored part from the IPF map corresponds to a crystal. From the results of measuring, average crystal size in the Example was 0.33 μm and equiaxial nanocrystals were uniformly distributed. In addition, since differences of angles of orientation in crystal particles of white crystals were not less than 3°, and since a region in which differences of angle of orientations in crystal particles were less than 3° was 92.5% in visual observation, it was confirmed that the crystal was a nanocrystal generated by dynamic recrystallization in which dislocation density was extremely low. Since the crystal was a nanocrystal and that dislocation was not induced very much, there may rarely occur cracking, and hardness was controlled while (having high strength), and post workability was superior. It is expected that mechanical property can be further improved by surface strengthening treatment such as shot peening.

Figure 2:
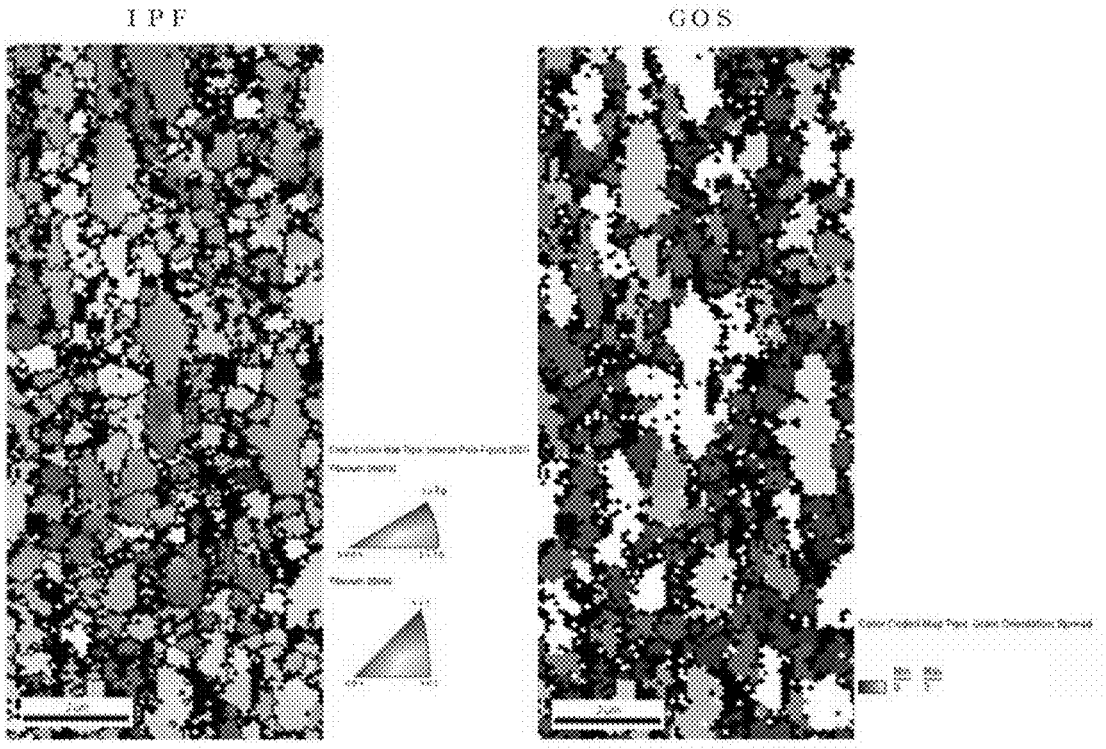
FIG. 2 shows an IPF map (left) and a GOS map (right) of an electron backscatter diffraction image after hot working of Ti-6Al-4V general standard composition alloy consisting of equiaxial crystal α+β, which is a starting material for processing of a Comparative Example of the present invention.

Ti-6Al-4V general standard alloy composition in which heating condition and processing condition are the same and the starting structure for processing is an α+β structure different from the Example, was prepared as a Comparative Example. FIG. 2 shows results of measuring electron backscatter diffraction after processing of a Comparative Example. According to the result, there are partially nanoscale equiaxial crystals; however, this consists of a mixture of structures with coarse particles, and its average crystal size was 2.47 μm. Furthermore, according to the GOS map, differences of angle of orientation in crystal particles was not less than 3°; that is, there were many crystals having high dislocation density (strain in particles). In addition, since differences of high dislocation density and low dislocation density were large and the variation region was rough, and since many coarse particles were contained, the structure had overall decreased hardness and low strength, derived from an ordinary structure.

Figure 3:
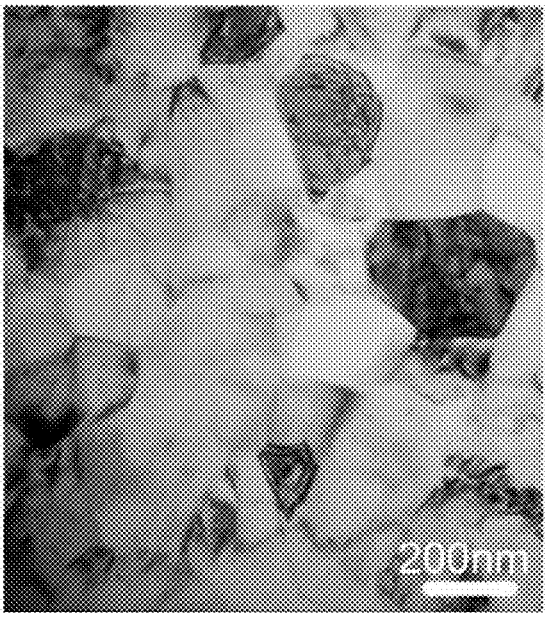
FIG. 3 shows a transmission electron microscope image after hot working of a Ti-6Al-4V general standard composition alloy consisting of an α' martensite, which is a starting material for processing of an Example of the present invention.
Figure 4:
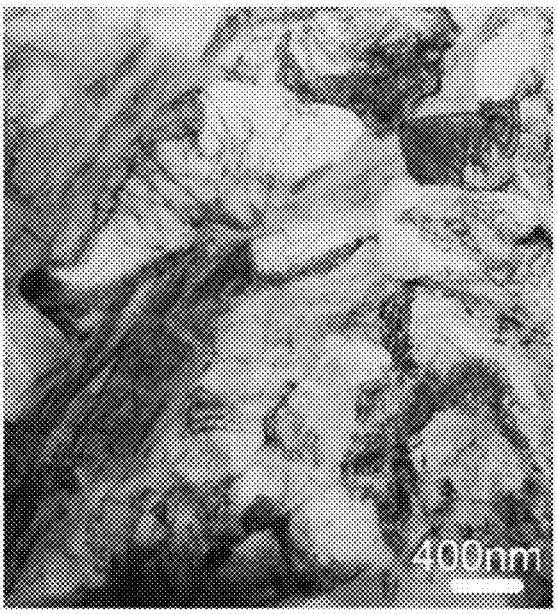
FIG. 4 shows a transmission electron microscope image after hot working of a Ti-6Al-4V general standard composition alloy consisting of equiaxial crystal α+β, which is starting material for processing of a Comparative Example of the present invention, under the same hot working conditions of the invention.

FIG. 3 shows a transmission electron microscope photograph of an Example. It was confirmed that sizes of equiaxial crystals generated by the processing was not more than 300 nm. FIG. 4 shows a transmission electron microscope photograph of a Comparative Example. Sizes of equiaxial crystals generated by processing of a condition similar to the Example of FIG. 3 was not less than 400 nm even at a small crystal size, and its average particle diameter was micron size.

Next, in addition to the abovementioned Comparative Example, which is a Ti-6Al-4V general standard composition alloy in which a starting structure for processing was an equiaxial crystal α+β structure, other Comparative Examples having compositions and structures shown in Table 1 were prepared. In Table 1, "bimodal α+β" means a Ti-6Al-4V general standard composition alloy of which solution treatment and aging treatment were performed on a general α+β phase expanded material that was not heated and processed. The structure of this Comparative Example consists of a mixture of structures of an α phase of an equiaxial crystal and a acicular crystal (bimodal) and a β phase. In addition, in Table 1, a "acicular α+β" was prepared by a similar starting structure for processing and similar processing conditions as those of the Example, but the heating temperature was not less than 1000° C., and the resulting structure consisted of a mixture of structures of acicular α phase and β phase.

TABLE 1

| | Alloy Composition | Alloy Structure | Average Crystal Size (μm) | β Ratio (Area %) | Not More Then GOS3* (Area %) | 0.2% Proof Stress (MPa) | Tensile Strength (MPa) | Hardness (HV) | Relative Value of Fatigue Strength at $10^6$ Times (Stress Ratio 0.1) |
|---|---|---|---|---|---|---|---|---|---|
| Example | Ti—6Al—4V | Nano Crystal α | 0.33~0.63 | 0.1~0.5 | 87.5~92.5 | 1193~1272 | 1274~1333 | 370~380 | 1.27~1.30 |
| Comparative Example | Ti—6Al—4V | Equlaxial Crystal α + β | 2.47~2.52 | 3.5~3.8 | 77.9~78.7 | 822~906 | 944~968 | 318~325 | 1.00 |
| | | Bimodal α + β | 4.03~4.25 | 1.5~1.7 | 82.1~84.0 | 968~989 | 1048~1072 | 352~366 | 0.98~1.03 |
| | | Acicular α + β | 231~2.55 | 0.1~0.3 | 95.2~96.2 | 997~1003 | 1154~1171 | 379~385 | 1.01~1.19 |
| | | Acicular α' | 4.72~5.15 | 0.1~0.3 | 78.9~82.4 | 932~943 | 1035~1054 | 392~403 | 1.08~1.15 |
| | Ti—6.8Mo—4.5Fe—1.5Al | Coarse β | 9.35~9.48 | 95.6~96.7 | 27.2~29.9 | 979~1095 | 1023~1132 | 332~345 | 0.37~0.40 |
| | | β + Precipitating α Phase | 9.03~9.21 | 91.7~92.8 | 29.6~33.2 | 1380~1484 | 1570~1597 | 442~467 | 0.74~0.80 |

In Table 1, "acicular α'" was the starting structure for processing of an Example as it was in which no heating and processing performed, "coarse β" was a Ti-6.8Mo-4.5Fe-1.5Al alloy having a coarse particle diameter β crystal in which no aging treatment was performed. In addition, "β+precipitating α phase" was an alloy that was the same as the above having a structure of a β phase and precipitating an α phase in which aging treatment was performed for 4 hours at 500° C.

Regarding the Comparative Examples, average crystal size, β ratio, GOS map, and mechanical property were measured in manners similar to those of the Example. The results are shown in Table 1. The Example was an equiaxial crystal having a maximal size of 630 nm, and a β ratio (area %) was not more than 1%. On the other hand, the Comparative Examples were of micron size crystals. In the Comparative Example Ti-6.8Mo-4.5Fe-1.5Al which is a β type Ti alloy, area ratio of differences of angle of orientation in crystal particles were not more than 3° was about 30% by GOS map measuring, and it was obvious that dislocation density (strain) was extremely high.

In the measurement of mechanical properties, tensile examination, hardness measurement and fatigue examination were performed. A plate type test piece having width of a parallel part of 2 mm, thickness of 1 mm, and distance between gage length of 10.5 mm was used as a tensile test piece. The fatigue examination was performed using an axial loading fatigue examination device, by producing a plate type test piece having a width of a parallel part of 2 mm, thickness of 1 mm, and length of 6 mm, which fits to the examination part. Average values of fatigue strength repeated $10^6$ times (stress ratio 0.1) of an equiaxial α+β structure which is a Ti-6Al-4V general standard composition alloy was defined as 1.0, and compared to each case of the Example and Comparative Examples relatively.

First, regarding the tensile examination results, the Example of the present invention exhibited superior tensile strength of not less than 1200 MPa, and 0.2% proof stress of 1160 to 1272 MPa, which is a good value. In addition, contrary to its high strength, hardness was controlled in a range of 370 to 380 HV. Therefore, further improvement of fatigue strength can be expected since large and deep compressive residual stress can be more easily accumulated to the surface thereof by shot peening or the like. Ordinarily, in order to increase tensile strength to not less than 1200 MPa in an α+β type alloy, it is necessary that hardness be increased more than in the Comparative Example of acicular α' structures, of not less than HV 400. However, since structures becomes brittle as hardness increases, and since cracking may easily occur and spread, a property of treatment of property-imparting to a surface such as shot peening and post workability such as machine processing may be deteriorated.

However, in a Ti-6.8Mo-4.5Fe-1.5Al alloy that is a metastable β type alloy, tensile strength of a Comparative Example of a coarse β structure was low. Furthermore, tensile strength of a Comparative Example of a β+precipitating α (precipitation aging treatment) structure was extremely high and hardness was increased at the same time; however, fatigue strength was not increased, as shown in Table 1. On the other hand, hardness was increased little compared to increase of tensile strength, and it was confirmed that properties due to the accumulating of properties to the surface and later workability were good.

Regarding results of fatigue examination, nanocrystallization was exhibited and dislocation density and hardness were controlled in an Example, improvement of up to 30% was observed compared to repeating fatigue limitation of an equiaxial α+β structure, and extremely superior fatigue strength was obtained. On the other hand, in a metastable β type alloy, regardless of whether aging treatment was performed or not, fatigue strength was extremely low. The reason is that even if an α phase is finely precipitated due to elastic strain difference of a β phase and an α phase existing between β crystals, cracking may occur and spread from interfaces of particles. This means that the balance of static strength and dynamic strength is not good. From the result shown in Table 1, it is expected that fatigue strength would be further improved by applying compressive stress at the surface in the Example of the present invention and the ability to produce very strong Ti alloy is expected. In particular, in the case in which the present invention is employed in a spring, a processing method is promising, in which nanocrystals are formed and then compressive residual stress is accumulated by shot peening, in a concentrated manner around a surface side that is maximally influenced by shear stress, not to the central part.

The invention claimed is:

1. A titanium alloy having a structure classified as near α, and comprising 4 to 9 mass % of Al, 2 to 10 mass % of V and the remainder of Ti and inevitable impurities, the alloy further comprising:

structure in which equiaxial crystals having average crystal particle diameter less than 1000 nm are uniformly dispersed, hardness less than 400 HV, an area ratio of a β phase is more than 0% and not more than 1.0%, by measurement of a phase map by an electron backscatter diffraction (EBSD) method, and tensile strength not less than 1200 MPa, wherein the titanium alloy is formed by performing hot working of a processing starting material in which an α' martensite phase is generated by rapid cooling from a temperature not less than a β transits temperature.

2. The titanium alloy according to claim 1, wherein an area ratio of crystals of orientation angles having a difference of less than 3° in crystal particles of the equiaxial crystal is not less than 80% by measurement of a GOS map by an electron backscatter diffraction (EBSD) method.

3. The titanium alloy according to claim 1, wherein a structure accounts for not less than 80% of area ratio, and the structure in which equiaxial crystals having average particle diameter of less than 1000 nm are uniformly dispersed freely at a cross section of a part at which structure is deformed by processing.

4. The titanium alloy according to claim 1, wherein the average crystal particle diameter of the equiaxial crystal is not more than 600 nm.

5. The titanium alloy according to claim 1, wherein the hardness is not less than 360 HV.

6. A production method for a titanium alloy according to claim 1, comprising a step of:

processing a titanium alloy having a composition of 4 to 9 mass % of Al, 2 to 10 mass % of V, and the remainder of Ti and inevitable impurities having an α' martensite phase generated by rapid cooling from a temperature not less than β transus temperature, by a processing method that can develop dynamic recrystallization, so that the titanium alloy has a hardness less than 400 HV and a tensile strength not less than 1200 MPa.

7. The production method for a titanium alloy according to claim 6, wherein the method comprises the steps of:

heating at a temperature increase rate of 50 to 800° C./sec, processing of strain of not less than 0.5 in a temperature range from 700 to 800° C. and a strain rate from 0.01 to 10/sec or in a temperature range of 800° C. to 1000° C. and a strain rate from 0.1 to 10/sec, and cooling at cooling rate not less than 20° C./sec.

8. The production method for a titanium alloy according to claim 7, wherein the method comprises a step of:

processing of strain of not less than 0.8 at a temperature range of 700 to 800° C. and a strain rate of 0.01 to 10/sec.

* * * * *